United States Patent [19]

Cohen et al.

[11] Patent Number: 5,046,952

[45] Date of Patent: Sep. 10, 1991

[54] RIGHT ANGLE CONNECTOR FOR MOUNTING TO PRINTED CIRCUIT BOARD

[75] Inventors: Thomas S. Cohen, Middletown; John R. Shuey, Mechanicsburg, both of Pa.

[73] Assignee: AMP Incorporated, Harrisburg, Pa.

[21] Appl. No.: 534,918

[22] Filed: Jun. 8, 1990

[51] Int. Cl.[5] ..... H01R 9/05; H01R 9/09

[52] U.S. Cl. ..... 439/63; 439/79

[58] Field of Search ..... 439/63, 79, 80, 83, 439/581

[56] References Cited

U.S. PATENT DOCUMENTS

| | | | |
|---|---|---|---|
| 4,605,269 | 8/1986 | Cohen et al. | 439/581 |
| 4,628,410 | 12/1986 | Goodman et al. | 439/83 |
| 4,738,637 | 4/1988 | Asick et al. | 439/610 |
| 4,767,345 | 8/1988 | Gutter et al. | 439/92 |
| 4,808,125 | 2/1989 | Waters et al. | 439/607 |
| 4,826,442 | 5/1989 | Douty et al. | 439/92 |
| 4,826,443 | 5/1989 | Lockard | 439/101 |

OTHER PUBLICATIONS

IBM Bulletin, Schick, vol. 7, No. 1, p. 91, 6-1964.

*Primary Examiner*—Neil Abrams

[57] ABSTRACT

An electrical connector assembly 1 for mounting on a printed circuit board, has terminals 17 for interconnecting with traces on the printed circuit board. The assembly 1 comprises a housing 4 with a mounting face 8 and a mating face 7 perpendicular to the mounting face 8. The housing has contact receiving passages 9, which extend rearward from the mating face 7 to the mounting face 8. Further included is a plurality of receptacle contacts 6 each adapted to be received within respective contact passages 9. Each receptacle contact 6 comprises an electrically conductive shell 12 which is adapted to be received within a respective contact passage 9. The receptacle contact 6 further includes a dielectric insert 11 having center bore 20 and adapted to be received and secured within each of the respective conductive shells 3. Each receptacle contact 6 further includes signal carrying center contact 10 pressed into the bore 20 of the dielectric insert 11. The signal carrying contact 10 comprises a finger-shaped mating section 13 and a compliant clip section 14 with arc shaped solder terminal 17 for interconnection with respective trace on the printed circuit board.

11 Claims, 4 Drawing Sheets

RIGHT ANGLE CONNECTOR FOR MOUNTING TO PRINTED CIRCUIT BOARD

FIELD OF THE INVENTION

The present invention relates to the field of electrical connectors, and more particularly to electrical plug connectors which are solderable to the surface of printed circuit boards.

BACKGROUND OF THE INVENTION

Electronic systems require signal carrying cables to transmit signals to and from the system. Many of these systems utilize discrete wire coaxial cables because of their relatively small diameter. These cables comprise a center signal carrying conductor and outer electrically conductive foil to provide shielding and a drain wire connected to the foil to maintain the foil at a reference potential.

Particularly useful are coaxial cable connectors which provide connection of these cables to printed circuit boards. One type of these connectors is mounted to a printed circuit board by soldering. Douty, et al, U.S. Pat. No. 4,826,442 relates to such electrical connector having a feature which permits it to be secured to the housing of the printed circuit board. The connector is mountable on the surface of the printed circuit board and comprises a dielectric housing having a mounting face and a mating face perpendicular thereto. The housing has contact passages extending rearwardly from the mating surface. The connector also includes a plurality of contacts secured in the passages and extending beyond the mounting face. Each of the contacts has a contact section connectable to corresponding circuit paths on the printed circuit board. The connector also includes a clip-receiving recess in the housing. Each clip-receiving recess includes a pair of spaced channels which define pairs of closely spaced opposed stop surfaces. Each pair of spaced channels is recessed from the mounting face and extends substantially parallel thereto. Included also is a solder clip insertable into each of at least one clip-receiving recess and extending between channels. The solder clip has a pair of side edges dimensioned to be received in the pair of spaced channels and moveable there along during insertion to thereby secure the solder clip to the housing when the side edges of the solder clip are received between the opposing stop surfaces of the pair of spaced channels. The solder clip can be attached to the housing subsequent to fabrication thereof, and when the solder clip is soldered to a printed circuit board, it functions as a mechanical retention feature that prevents lateral forces applied to the connector from rotating the connector away from the printed circuit board. Desirable would be a connector for a cable assembly which would permit a cable, terminated in a female connection, to be connected via a solderable connector to a printed circuit board. Further desirable would be a connector for a female terminated cable assembly which would provide a compression mating of solder terminals to respective traces of the printed circuit board. The connector of the present invention meets these desired objectives and further provides a structure for targeting the spot connection between solder terminal and trace. With the connector of the present invention, the point of contact of a solder terminal is maintained under compression and at the precise location of desired connection with the trace.

SUMMARY OF THE INVENTION

This invention is an electrical connector assembly for mounting on a printed circuit board. The assembly has ground and terminals for interconnecting with traces on the printed circuit board. The assembly comprises a housing having a mounting face and a mating face with the mating face perpendicular to the mounting face. The housing has contact passages extending rearwardly from the mating face to the mounting face. The electrical connector further includes a plurality of receptacle contacts. Each receptacle contact is adapted to be received within a respective contact passage of the housing. Further included is a plurality of dielectric inserts. Each of the inserts has a center bore and each is adapted to be received and secured within a respective conductive shell. Further, the electrical connector includes a plurality of signal carrying contacts, each pressed into the bore of a respective insert. Each of the contacts comprises a finger-shaped mating section and compliant clip section. Each clip section has arc-shaped solder terminal for interconnection with respective trace on the printed circuit board. By the unique shape of the signal carrying contacts, is provided a structure that both permits connection to a cable terminated in a male connector and, within the same structure, provides clip section as a solder terminal for compression contact to traces of a printed circuit board.

DETAILED DESCRIPTION OF THE INVENTION

Figure 1:
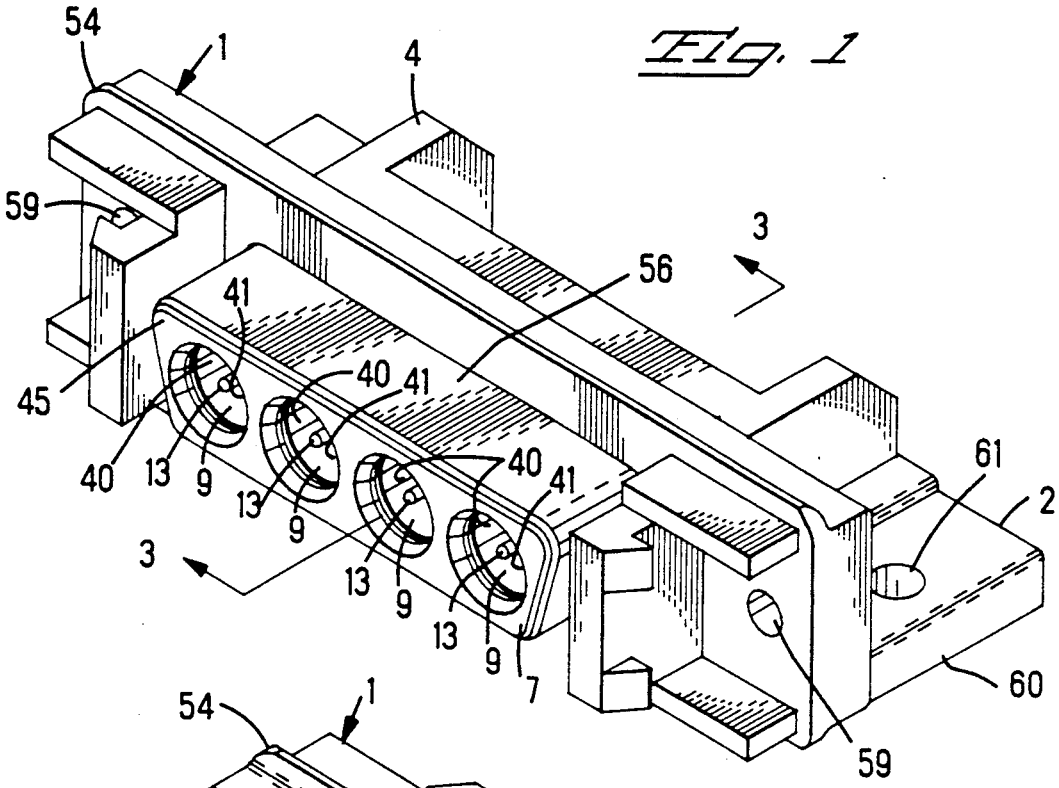
FIG. 1 is a perspective view toward the front face of the electrical connector assembly of the present invention.
Figure 2:
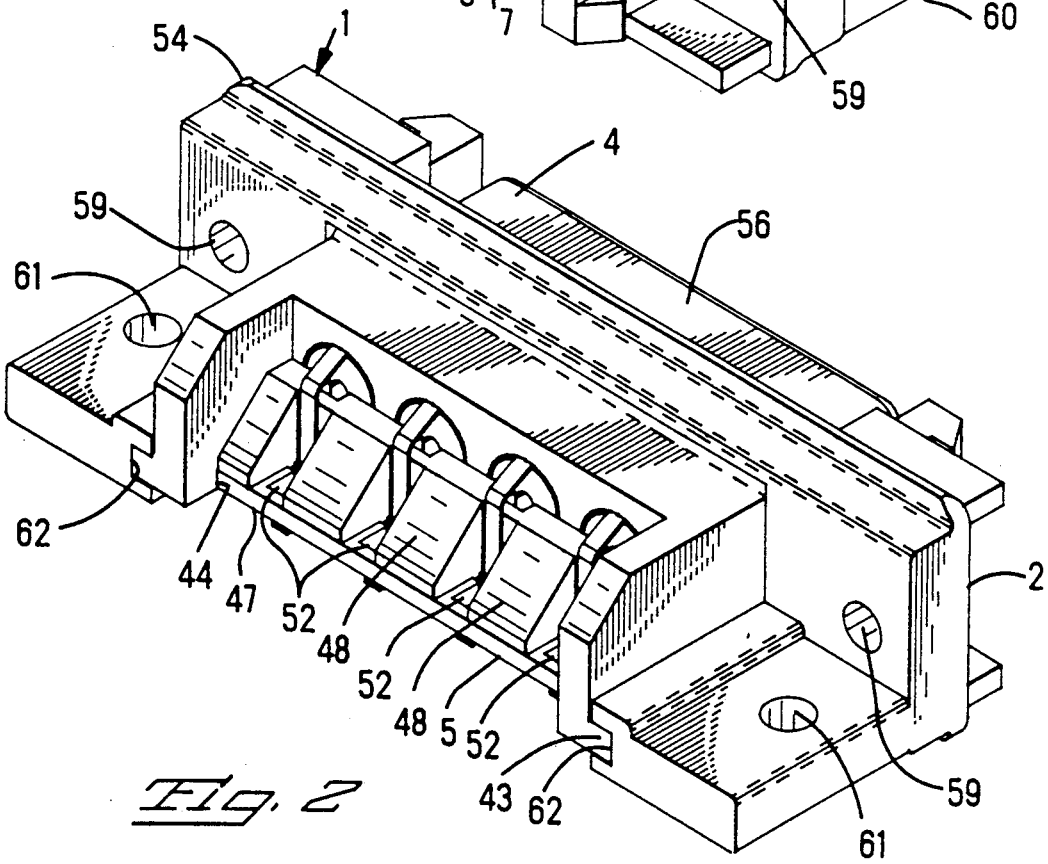
FIG. 2 is a perspective view toward the rear face of the electrical connector assembly.

Referring to FIGS. 1, 2, 3, and 4, there is depicted an electrical connector assembly 1 in accord with the present invention. Electrical connector assembly 1 comprises mounting bracket 2, metal shell 3, thermal plastic housing 4, contact spacer 5, and receptacle contact 6. Electrical connector assembly has mating face 7, mounting face 8, and contact receiving passages 9 extending between the faces 7 and 8 and having signal carrying contacts 10 secured therein.

Figure 3:
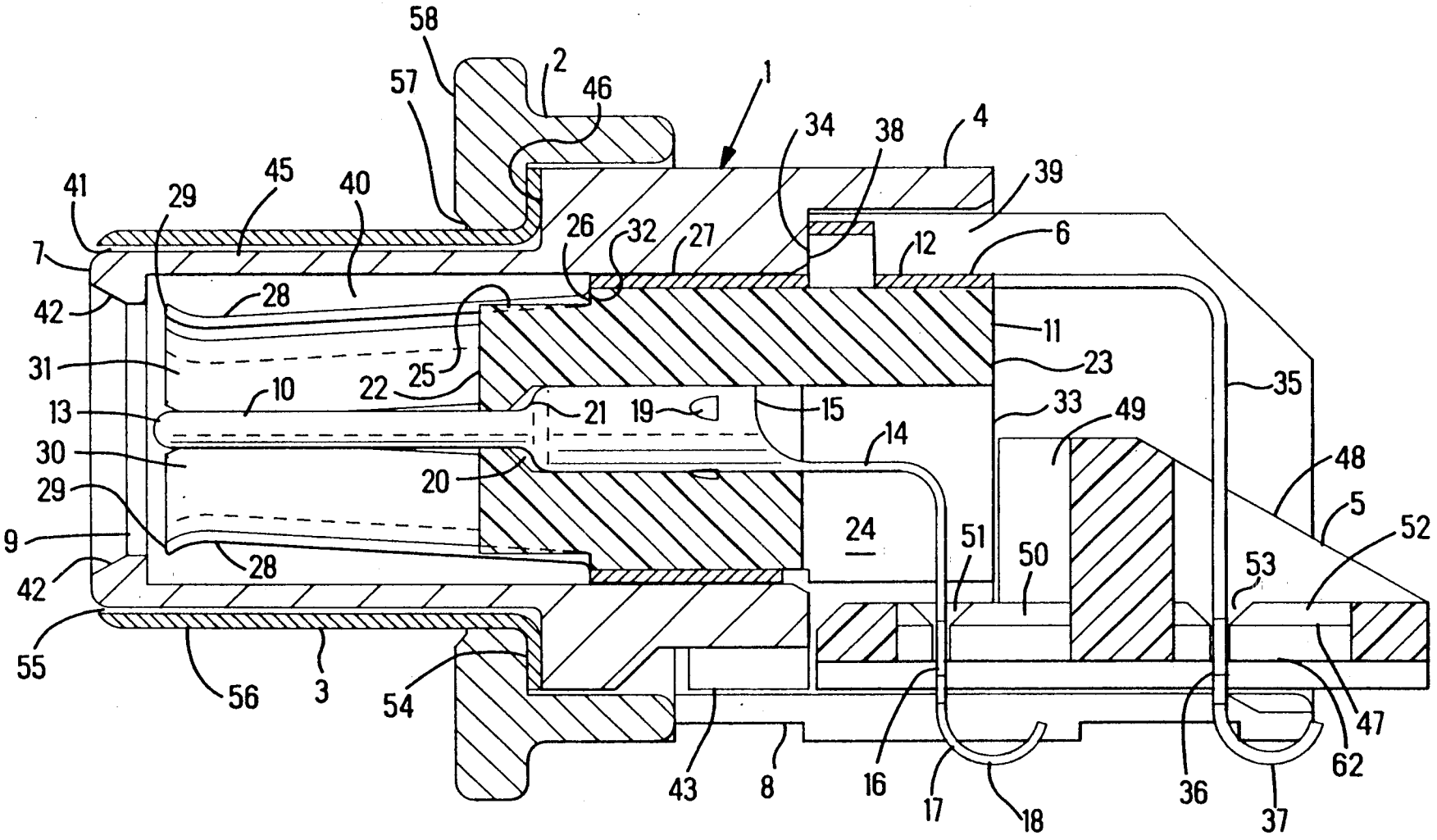
FIG. 3 is a section view of the electrical connector assembly.
Figure 4:
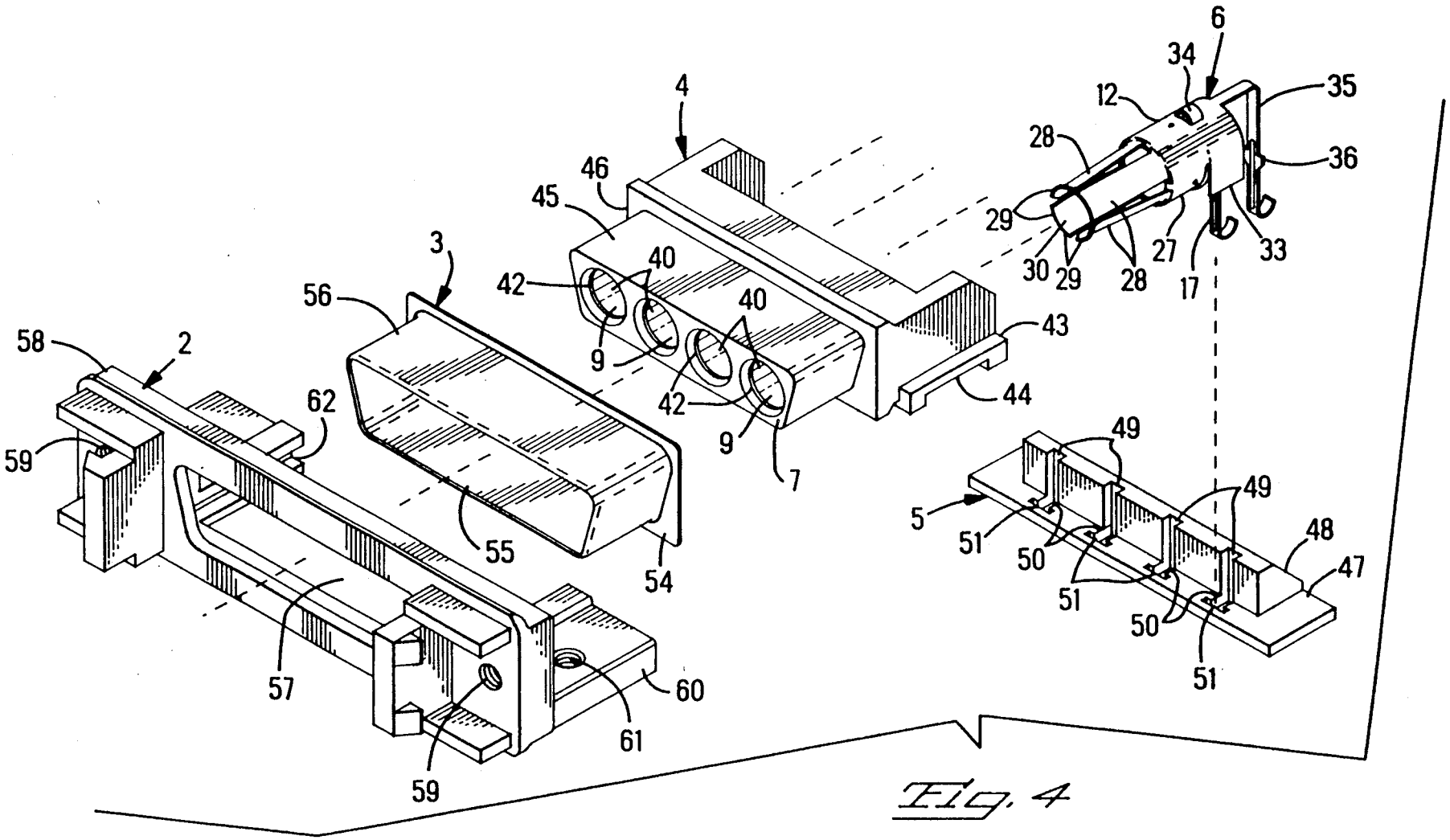
FIG. 4 is an exploded perspective view of the electrical connector assembly showing one of the signal carrying receptacle contacts of the present invention.

Mounting face 8 of the electrical connector assembly 1 is at a right angle with respect to mating face 7. Contacts 10 extend from mating face 7 through contact receiving passages 9, then substantially perpendicular to pass through mounting face 8 as shown in FIG. 3.

Figure 5:
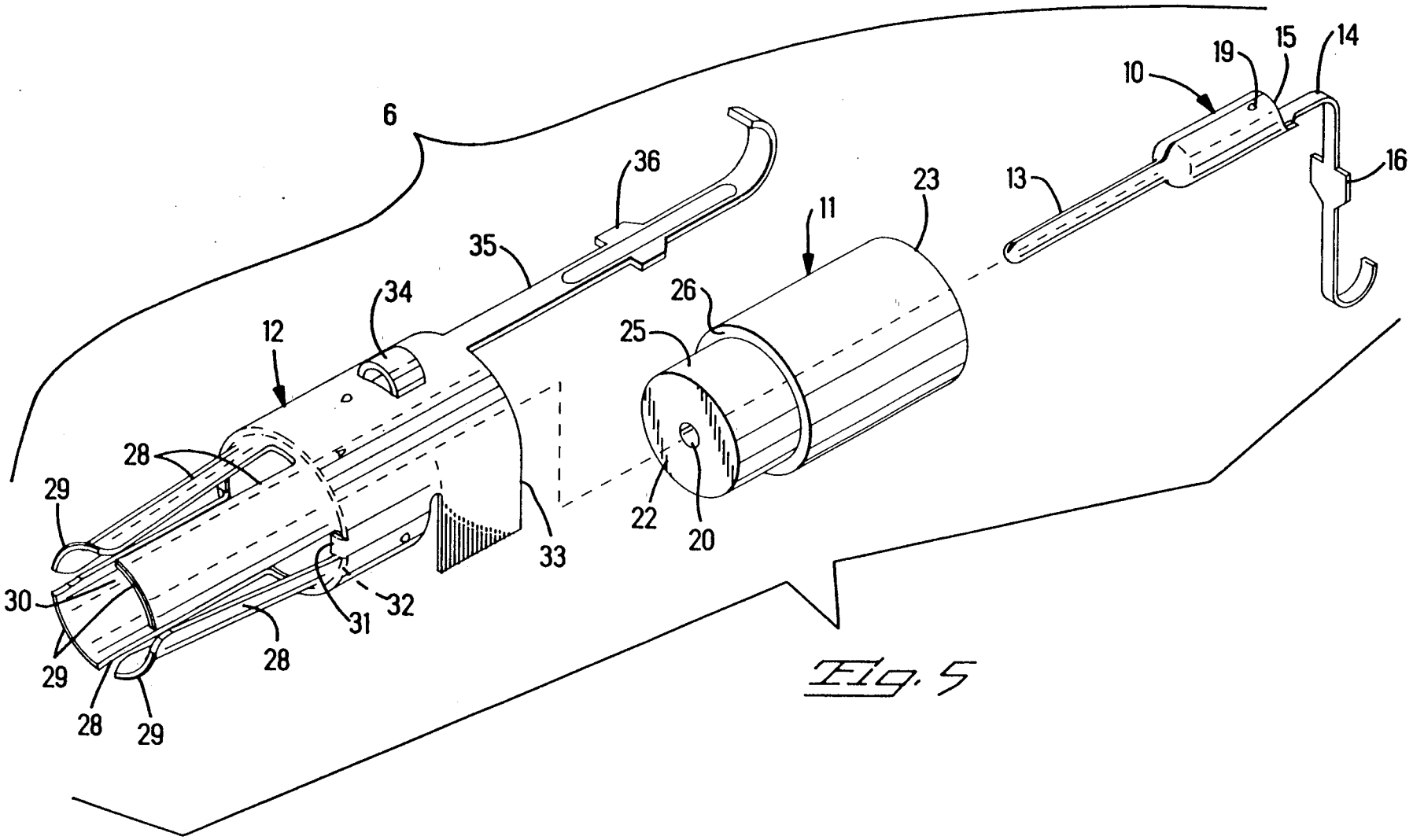
FIG. 5 is an exploded perspective view of the receptacle contact of the present invention showing conductive shell, dielectric insert, and signal carrying center contact.

With additional reference to FIG. 5, shown is one of the receptacle contacts 6 including signal carrying center contact 10, dielectric insert 11 and electrically conductive shell 12. Each contact 10, within the electrically conductive shell 12, comprises finger shaped mating section 13, compliant clip section 14, and an intermediate cylindrical stabilizing section 15. Compliant clip section 14 includes barb-shaped section 16 and solder terminal 17 ending in an arc end for soldering to the pad of a printed circuit board as hereinafter described. Locking dimple 19 is located on the intermediate cylindrical stabilizing section. The interplay between intermediate cylindrical stabilizing section 15 and compliant clip section 14 permits the clip section to be compressed by contact against traces of the printed circuit board while at the same time assures the fit of finger-shaped mating section, oriented at 90° to the solder terminal, to connect to form a secure connection with a female connector.

Signal carrying center contact 10 is slidingly received within the axial bore 20 of dielectric insert 11, with finger-shaped mating section 13, extending through guided exit way 21, and through front face 22 of dielectric insert 11. When inserted, finger-shaped mating section 13 extends through guided exit way 21 with intermediate cylindrical stabilizing section 15 filling the axial bore 20 of the dielectric insert 11 with locking dimple 19 imposed into the wall of the axial bore 20. The intermediate cylindrical stabilizing section 15 tapers to solder terminal 17, with the terminal 17 extending further through the axial bore 20, thence to a 90° angle to exit through the outer cylindrical portion 23 through slot 24 of the insert 11. Insert 11 has profiled outer surface with shaped cylindrical portion 23 and forward cylindrical portion 25 of reduced diameter to form shoulder 26.

Conductive shell 12 of the receptacle contact 6 comprises main cylindrical body 27, a plurality of resilient cantilevered arms 28 with flared front face portions 29 forming mating socket 30. Insert 11 along with contact 10, fits within bore 31 abutting the shaped inner shoulders 32 formed by the intersection of cantilevered arms 28 with main cylindrical body 27. Shell 12 further has parted and extended wall portion forming a canopy 33 which shrouds contact terminal 17. The canopy 33 formed by the parting of the wall and its extension to shroud the compliant clip section 14 results in improved impedance characteristics. The canopy isolates pairs of grounds 35 and corresponding signal carrying contacts 14 to shield the grounds 35 and contacts 14 thereby reducing cross talk. Shell 12 has dimple 34 which resides against stop 38 of housing 4 as hereinafter described and ground contact 35 with barb-shaped section 36 and arc end 37.

Electrically conductive shell 12 with dielectric insert 11 and signal carrying contact 10 forming receptacle contact 6 are slidingly insertable within axial bore 39 of the inner enlarged diameter of the inner profile of each of passages 7 of housing 4 with dimple 34 resting against stop 38 formed by the shoulder at the intersection of the axial bore portion 39, of inner large diameter, with the axial bore portion 40, of inner narrow diameter. Mating socket 30 extends through the said axial bore 40 of inner narrow diameter. Inwardly beveled face 42 is provided at the entrance way 41 of bore 40 of the front mounting face 8 of the housing 4. Housing 4 further has base 43 with slot 44 for accommodating contact spacer 5. Cowling 45 encompasses passages 7 and extends from wall 46 which abuts panel 54, and rests within aperture 55 of metal shell 3 when housing 4 is engaged thereto, as hereinafter described.

Contact spacer 5 comprises platform 47 and upper structure 48 with guides 49. Forward apertures 50 of platform 47 have slots 51 to accommodate barbs 16 of solder tails 17 of signal carrying center contacts 10. Opposing edges of each of barb 16 are received within respective slots 51 to permit transverse movement along the axis of guide 49 of each of terminal 17 while at the same time maintaining each of the compliant clip sections 14 in relative position within each of the slots 51. Platform 47 has rearward apertures 52 with slots 53 to accommodate each of barbs 36 to orient each ground contact 35 of conductive shell 12 to thereby perform a function analogous to that of slots 51. Each terminal ground contact 35 is permitted to move transversely along the axis of the slot 53 so as to permit compression of arc end 37 against the solder pad of a printed circuit board while, at the same time, maintaining the orientation of the solder tail 35 against the pad and maintaining it in relative position within the said apertures 52.

Metal shell 3 has a panel 54, through aperture 55, and collar 56. Mounting bracket 2 comprises port 57, through upright section 58, and threaded holes 59 for receiving attachment of the housing of a female connector, and base section 60, which includes threaded holes 61 for attachment to the housing of a printed circuit board.

After the insertion of each receptacle contact 6 within contact receiving passage 9 of housing 4, ground contact 35 is bent to a 90° angle and contact spacer 5 is fitted to the slot 44 of base 43 of housing 4 to capture the receptacle contact 6, with compliant clip section 14 received within slot 51 and ground contact 35 received within slot 53. Arc ends for soldering to the printed circuit board are then formed by bending of the ends 18, 37 of both solder terminal 17 of clip section 14 and solder terminal 35 of shell 12 as shown in FIG. 3. Cowling 45 of housing 4 is then inserted through aperture 55 and collar 56 of metal shell 3, with panel 3 of the metal shell 3 abutting against wall 46. Thereafter, metal shell 3, housing 4, receptacle contact 6, and contact spacer 5, as a unit, are inserted into the port 57 of upright section 58 of bracket 2 with base 43 slidingly connected into channel 62.

Electrical connector assembly 1 is connected to the printed circuit board by threaded bolts through holes 61. The attachment of the electrical connector assembly 1 to the printed circuit board imposes against both the arc ends 18 of compliant clip sections 14 of signal carrying contacts 10, and arc ends 37 of ground contacts 35 of shell 3, to bias the arc ends upward. The resulting compression fit assures that the soldering process will secure the tails and other components to the board at the precise and targeted desired spot between solder terminal and trace. The point of contact of the solder terminal is maintained in compression, while soldering, to assure electrically conductive contact.

While what has been described constitutes a presently preferred embodiment of the invention, it should be recognized that the electrical connector assembly may take numerous other forms. Accordingly, it should be understood that the invention is to be limited only insofar as required by the scope of the following claims.

We claim:

1. An electrical connector assembly for mounting on a printed circuit board having a ground, said assembly having terminals for interconnecting with traces on the printed circuit board, and comprising; a housing having a mounting face and a mating face perpendicular thereto, said housing having contact passages extending rearwardly from said mating face to said mounting face, said housing being characterized by shaped apertures with slots imposed into opposing edges of said shaped apertures at said mounting face; and a plurality of receptacle contacts adapted to be received within respective contact passages, each receptacle contact comprising:

an electrically conductive shell adapted to be received within respective contact passage;

a dielectric insert having a center bore and adapted to be received and secured within said conductive shell; and a signal carrying contact pressed into the bore of said insert and comprising a finger-shaped mating section and a compliant clip section with arc-shaped solder terminal for interconnection with a respective trace on the printed circuit board, the opposing edges of each clip section being received within a respective slot to permit transverse movement of each clip section away from the circuit board to compress each arc-shaped solder terminal into interconnection with the respective trace while maintaining each clip section in relative position within each slot.

2. The electrical connector assembly of claim 1 wherein each of the complaint clip sections is characterized by barb-shaped section that fits within the slot of each of the said shaped apertures.

3. The electrical connector assembly of claim 2 wherein said signal carrying contact includes an intermediate section of enlarged diameter between said finger-shaped mating section and said compliant clip section.

4. The electrical connector assembly of claim 3 wherein said intermediate section of enlarged diameter gradually tapers to said compliant clip section.

5. The electrical connector assembly of claim 1, 2, or 3 wherein said conductive shell is further characterized by compliant clip section with arc shaped solder terminal for interconnection as a ground contact to respective trace on a printed circuit board.

6. The electrical connector assembly of claim 1, wherein said electrically conductive shell further comprises a canopy formed by parting of the wall of said shell and extending on either side of said compliant clip section of the signal carrying contact to shroud said contact tail.

7. The electrical connector assembly of claim 1 or claim 6 wherein each said electrically conductive shell includes a compliant ground contact with arc-shaped end for solder connection to a ground of the printed circuit board.

8. The electrical connector assembly of claim 7 wherein each said electrically conductive shell includes a plurality of resilient cantilevered arms with flared front face portions forming a receptacle for receiving an electrical connector.

9. The electrical connector assembly of claim 8 wherein the housing is characterized by additional shaped apertures with slots imposed into opposing edges of said shaped apertures at said mounting face and, further, wherein the opposing edges of each of said compliant ground contact is received within a respective slot of said additional apertures to permit transverse movement of said ground contact to compress each of said arc-shaped end into interconnection with grounding trace of said printed circuit board while maintaining each of said compliant ground sections in relative positions within each of said slots.

10. The electrical connector assembly of claim 9 wherein each of the compliant ground contacts is characterized by barb-shaped section that fits within the slot of each of the said additional shaped apertures.

11. An electrical connector assembly for mounting on a printed circuit board having a ground, said assembly comprising; a housing having a mounting face and a mating face perpendicular thereto, said housing having contact passages extending rearwardly from said mating face to said mounting face, said housing being characterized by shaped apertures with slots imposed into opposing edges of said shaped apertures at said mounting face; and a plurality of receptacle contacts adapted to be received within respective contact passages, each receptacle contact comprising:

an electrically conductive shell adapted to be received within the respective contact passage;

a dielectric insert having a center bore and adapted to be received and secured within said conductive shell; and a signal carrying contact pressed into the bore of said insert and comprising a finger-shaped mating section and a compliant clip section, opposing edges of each clip section being received within a respective slot to permit transverse movement of each clip section away from the circuit board while maintaining each clip section in relative position within each slot.

* * * * *